United States Patent [19]

Jackson

[11] 4,247,505

[45] Jan. 27, 1981

[54] MELT SPINNING OF POLYMERS

[75] Inventor: Henry G. Jackson, Greenville, S.C.

[73] Assignee: Phillips Petroleum Company, Bartlesville, Okla.

[21] Appl. No.: 903,261

[22] Filed: May 5, 1978

[51] Int. Cl.[3] ..... D01D 5/08

[52] U.S. Cl. ..... 264/176 F; 28/247; 264/130; 264/136; 264/210.3

[58] Field of Search ..... 264/216 F, 103, 176 F, 264/210.3, 130, 136; 28/247

[56] References Cited

U.S. PATENT DOCUMENTS

| | | | |
|---|---|---|---|
| 2,186,135 | 1/1940 | Childs | 264/210.8 |
| 2,979,766 | 4/1961 | Briggs et al. | 264/176 F |
| 3,041,663 | 7/1962 | Green | 264/176 F |
| 3,108,322 | 10/1963 | Tate | 264/176 F |
| 3,346,684 | 10/1967 | Gorden | 264/176 F |
| 3,516,809 | 6/1970 | Underwood et al. | 264/176 F |
| 3,529,323 | 9/1970 | Hughes | 264/176 F |
| 3,555,808 | 1/1971 | Gutmann | 264/176 F |
| 3,684,416 | 8/1972 | Lenk | 264/176 F |
| 3,715,421 | 2/1973 | Martin et al. | 264/210 F |
| 3,946,100 | 3/1976 | Davis et al. | 284/210 F |
| 3,988,086 | 10/1976 | Marshall et al. | 264/176 F |
| 3,994,121 | 11/1976 | Adams | 264/210 F |
| 3,996,324 | 12/1976 | Landenberger et al. | 284/210 F |
| 4,000,238 | 12/1976 | Maurer | 284/210 F |
| 4,049,763 | 9/1977 | Mineo et al. | 264/176 F |
| 4,069,657 | 1/1978 | Bascom et al. | 264/210 F |
| 4,093,147 | 6/1978 | Bromley et al. | 264/210 F |
| 4,101,525 | 7/1978 | Davis et al. | 264/210 F |

FOREIGN PATENT DOCUMENTS

| | | | |
|---|---|---|---|
| 2505547 | 8/1976 | Fed. Rep. of Germany | 264/103 |
| 40-21688 | 9/1965 | Japan | 264/107 |
| 48-23805 | 7/1973 | Japan | 264/103 |
| 49-19119 | 2/1974 | Japan | 264/210 F |
| 51-7204 | 3/1976 | Japan | 264/103 |
| 51-96522 | 8/1976 | Japan | 264/210 F |

*Primary Examiner*—Jay H. Woo

[57] ABSTRACT

Polymers are melt spun by extruding threadlines of filaments from a spinneret; quenching the filaments through a quench zone; reducing the tension on the threadlines of filaments to a value substantially equal to the tension at the hereinafter-mentioned winding point, by converging each threadline of filaments to form a strand while applying a lubricant; and winding each strand on a spool at a take-up speed of at least about 1800 meters per minute, and without further reducing the tension by means, such as godets. Apparatus for carrying out the method is described. The convergence means may be adjustable to change the position thereof relative to the bottom of the quench zone.

13 Claims, 7 Drawing Figures

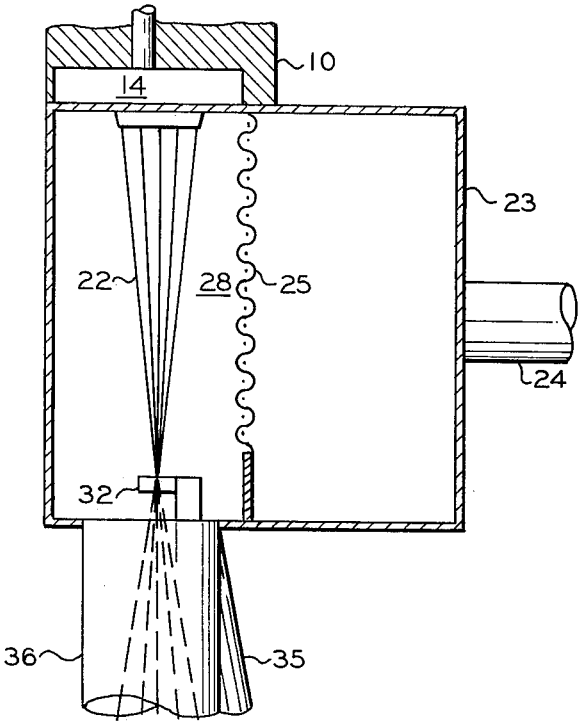
FIG. 2
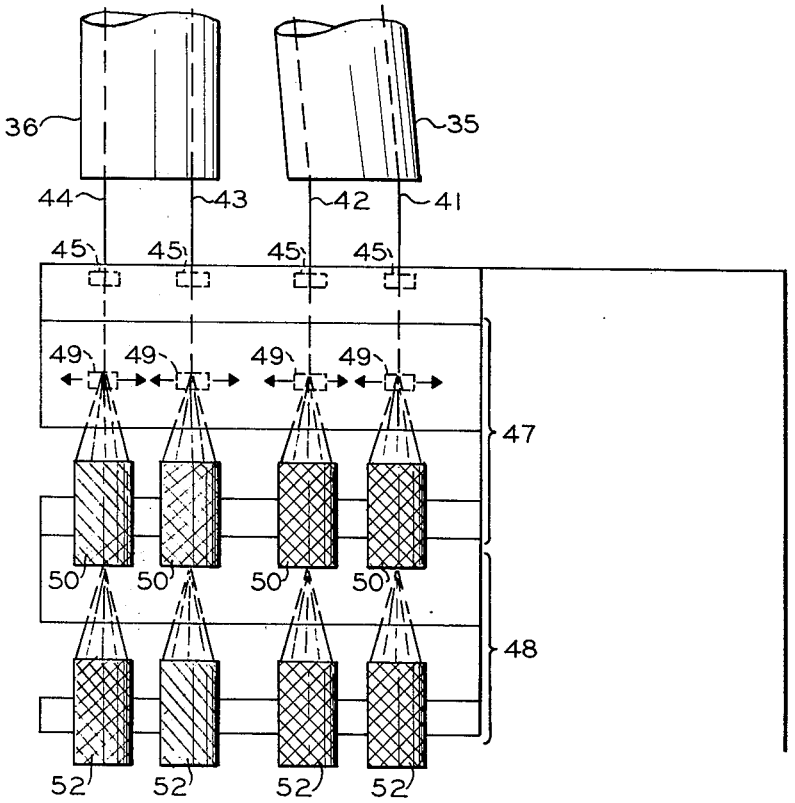

MELT SPINNING OF POLYMERS

BACKGROUND OF THE INVENTION

The present invention relates to high speed, melt spinning of polymeric filaments. More specifically, the present invention relates to high speed, melt spinning of polymeric filaments in which tensioning rollers between the extrusion and winding stages are eliminated.

Melt spinning of polymeric filaments to produce strands, yarns or threads from a plurality of such filaments is well known in the art. Generally, in such processes, molten polymer is extruded through a spinneret head having a plurality of extrusion dies. A single die head or spinneret produces a plurality of individual filaments commonly referred to as a threadline of filaments. The threadline of filaments then passes through a quenching chamber wherein the filaments are cooled by forcing air through the chamber normal to the direction of filament travel in order to cure or harden the filaments. Following the quenching of the threadline of filaments, the threadline of filaments is converged to form a single strand, yarn or thread therefrom. The nature and location of this point of convergence varies widely in the art. However, normally the threadline of filaments passes through a convergence guide or over a roller where partial convergence of the threadline of filaments occurs. The partially converged threadline then normally passes through an interfloor guide or tube to a finish applicator where finish is applied to the threadline and thence to godet rolls where the threadlines are wrapped around one or more godet rolls to reduce the tension on the threadlines to a value at which a winding apparatus can effectively operate. Unless the tension is thus reduced, serious problems are encountered during the winding operation, due to the breaking of the filaments, poor winding or the like. Complete convergence of the threadline of filaments to form a single strand quite often takes place either at or adjacent the godet rolls or at the traverse guide which is utilized to spread the threadline across the spindle of the winding apparatus. In this conventional type of melt spinning, winding take-up speeds of less than about 1800 meters per minute are utilized. Thereafter, the wound strand or yarn is drawn by means of draw rollers, to a length about 3 to 4 times its original length. The conventional melt spinning technique generally produces strands which are referred to in the art as a "non-oriented yarn" or withdrawn yarn, hence the necessity of the radical drawing and usually a subsequent texturing operation.

It is also known in the art to melt spin polymeric filaments while utilizing high speeds above about 1800 meters per minute during the winding operation. In this case, the resultant yarns are referred to as "partially oriented yarns (POY)" or partially drawn yarns, primarily to distinguish these yarns from the so-called non-oriented yarns. Such high speed spinning produces a yarn for subsequent treatment in what is known as a draw texturing operation. In draw texturing the yarn is drawn and given a false twist texture in a single operation without intermediate winding. Draw texturing can be sequential, in which the drawing rolls are upstream of the twisting spindle, or simultaneous, in which the drawing is done through the twisting zone. In any event, the drawing in this case is only 1 to 2 times the original length, due to the fact that the yarn is already partially oriented. Normally, in high speed spinning, the threadlines converge at a roll or rollers at the bottom of the quench cabinet then pass through an interfloor tube carrying a plurality of threadlines in a single tube. The threadlines are then wrapped around one or more godet rollers to reduce the tension and are thereafter fed around one or more winders or to a draw texturing means. The problem in this operation is that when one threadline breaks, then all threadlines, passing through a single quench cabinet, through a single interfloor tube and about a single set of godets, have to be broken out and restrung. Usually for threadlines pass through a single quench zone and through a single interfloor tube, thus greatly exaggerating the problem. Obviously, this interrupts normal operations, requires substantial expenditures of labor and is quite inefficient overall. High speed spinning also exaggerates the problem of threadline breakage, since the tension at the godet rolls is normally about 100 grams, due to the fact that the filaments of unconverged yarn experience high air drag passing through the quench chamber, and the godets must reduce this tension to about 25 grams.

It would be highly desirable if the number of threadlines processed in high speed melt spinning could be substantially increased. For example, doubling the number of threadlines per spinneret and the number of threadlines per quench column and interfloor tube would substantially improve the throughput of the spinning apparatus. However, having, for example, eight threadlines per quench column and eight threadlines per interfloor tube would create insurmountable operational problems (i.e., if one threadline breaks, normally all eight threadlines would break or would have to be broken in order to restring the one broken line). This problem would be greatly accentuated if godet rollers are used. At some point all eight strands have to pass over the godet rollers and when any one end breaks out, all or most of the other ends will break out, thus restringing of the godet rolls would be an extremely time consuming, laborious and inefficient operation.

It is therefore an object of the present invention to provide a method and apparatus for melt spinning of polymeric filaments wherein the rate of production is substantially improved. Another object of the present invention is to provide an improved method and apparatus for high speed melt spinning of polymeric filaments which is highly efficient in its use of equipment, space, time and labor. These and other objects of the present invention will be apparent to one skilled in the art from the following description of the present invention.

SUMMARY OF THE INVENTION

The above and other objects and advantages of the present invention are obtained by extruding at least one threadline of filaments from a molten polymer; passing the threadline of filaments through a quenching zone to quench the same, reducing the tension on the threadline of filaments, by converging the threadline of filaments against a stationary guide to form a single strand, yarn or thread, at a point immediately adjacent the bottom of the quenching zone, and while simultaneously applying a lubricant to the surfaces of the guide which are in contact with the threadline of filaments; and, finally, winding the strand at a takeup speed of at least about 1800 meters per minute without further reducing the tension. In its preferred form, no more than two threadlines of filaments pass through a single quench zone or a single interfloor tube, the tension is reduced by utilizing a converging means comprising a V-shaped, ceramic guide supplied with lubricant under pressure and the winding speed can be increased to at least 3200 meters per minute.

By utilizing tension reducing means, which comprises a stationary guide and lubricating means, at a point immediately adjacent the bottom of the quench chamber, and thus reducing the tension to a value substantially equal to that at the winding apparatus, godet rolls and their attendant problems can be completely eliminated. Further, by limiting the number of threadlines of filaments which pass through a single quenching zone and a single interfloor tube, substantial savings of time, space, labor and equipment can be effected and by producing as many as eight or more threadlines from a single spinning block and simply duplicating the two threadline apparatus, productivity and efficiency are still further increased.

BRIEF DESCRIPTION OF THE DRAWINGS

FIGS. 1 and 2 of the drawings schematically show front and right side elevations of the overall apparatus of the present invention.

FIGS. 6 and 7 are partial, enlarged, front and top views of the tension reducing means.

DETAILED DESCRIPTION OF THE PREFERRED EMBODIMENTS

Figure 1:
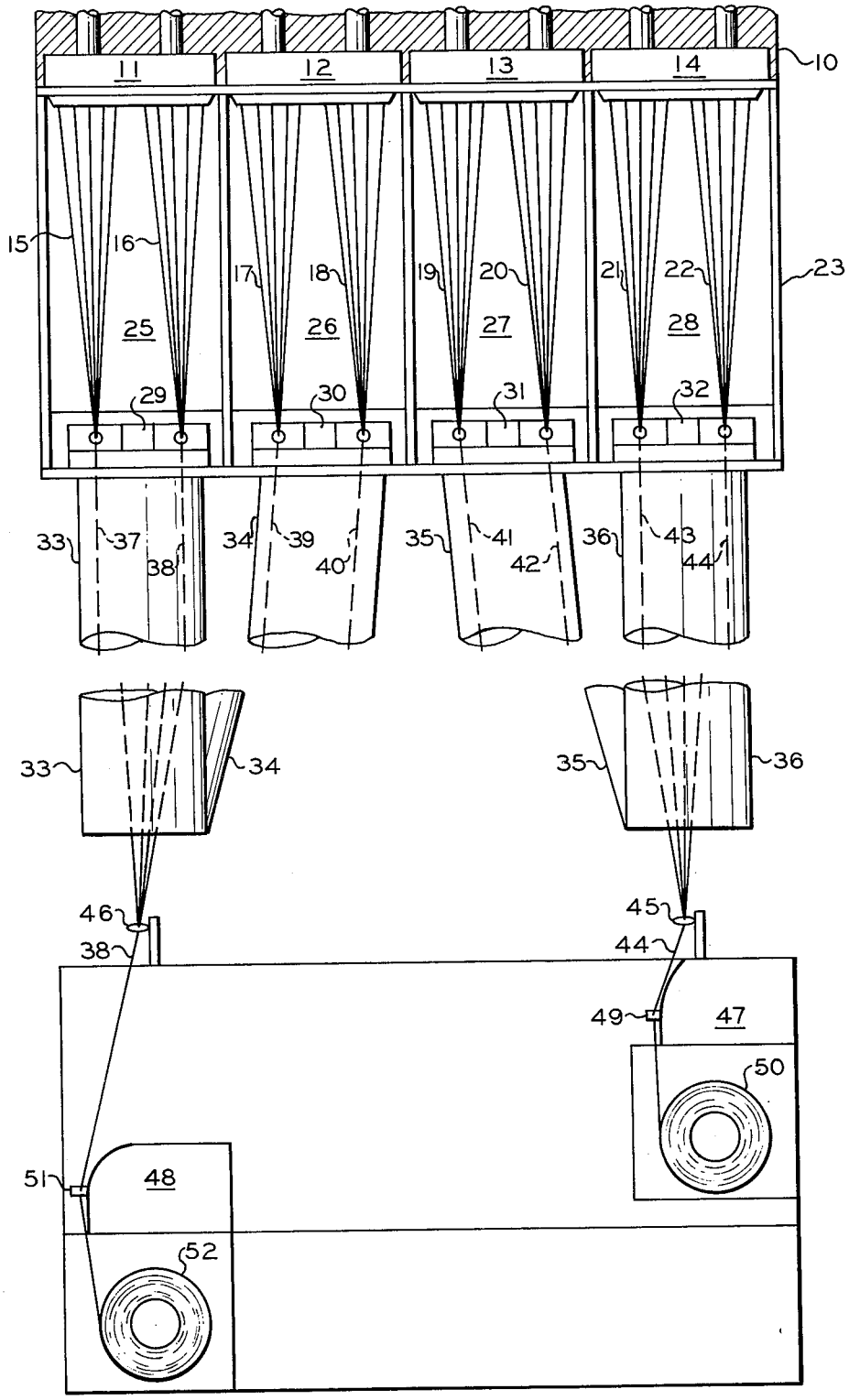
Figure 3:
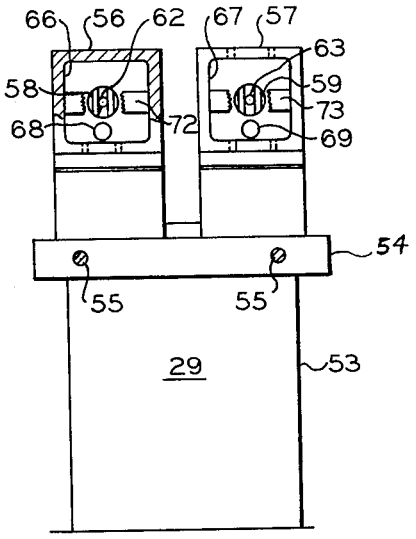
FIGS. 3, 4, 5 and 6 are detailed front, top and right side views, partially in section, of the tension reducing means of the present invention.
Figure 4:
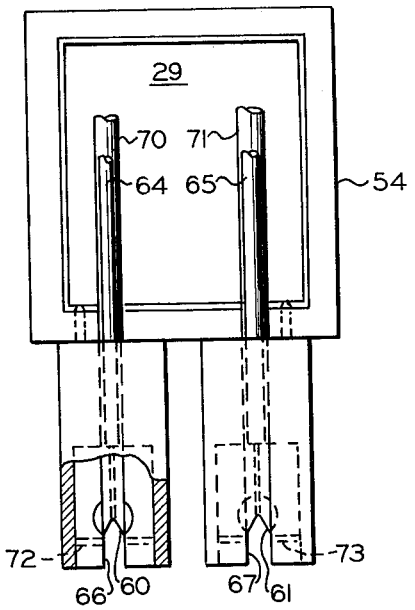
Figure 5:
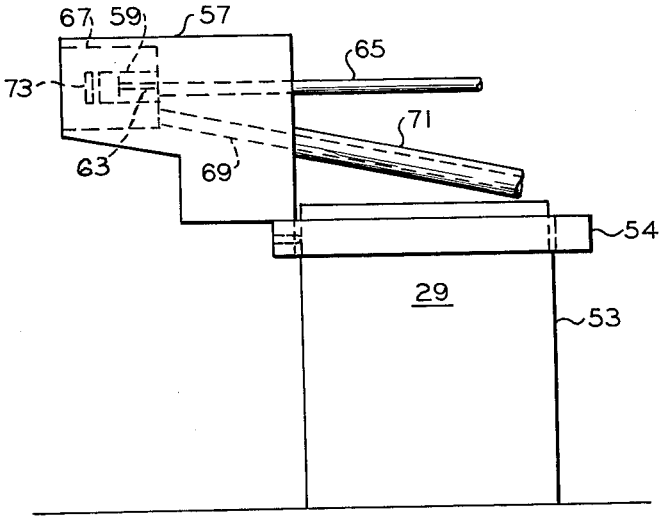
Figure 7:
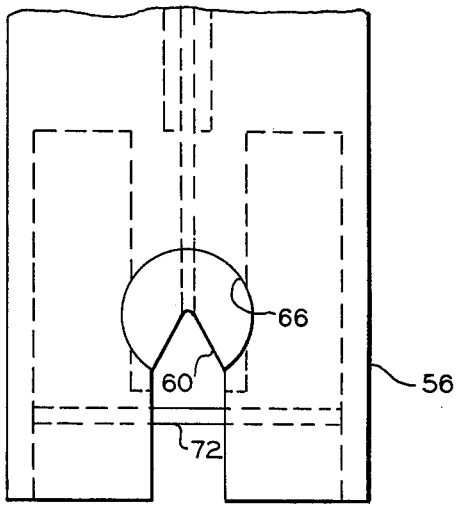
Figure 6:
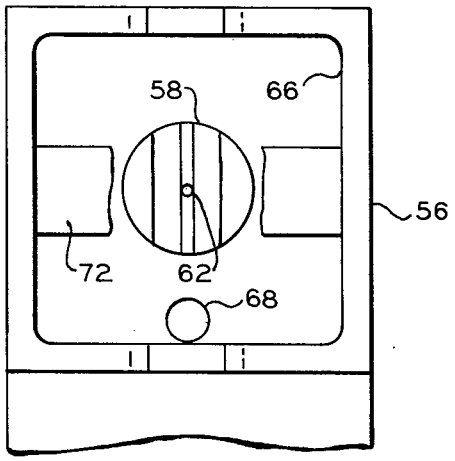

In a specific embodiment of the invention, each of four spinnerets has two heads with 34 dies and each die has a diameter of about 0.34 millimeters and a length of about 0.68 millimeters. Thus, each spinneret produces two threadlines and the four spinnerets produce a total of eight threadlines. The threadlines then pass directly through a quenching chamber which is divided into four quenching zones, each adapted to receive the two threadlines from a single spinneret. Air is supplied to the quenching chamber at the velocity of about 40 to 120 feet per minute and, preferably about 60 feet per minute. Immediately adjacent the bottom of each quenching zone is a pair of tension reducing means. The tension reducing means includes a V-shaped, ceramic guide which converges the threadlines into a single strand, yarn or thread and a lubricant application means, which supplies lubricant under pressure to the surfaces of the guide which are in contact with the threadline of filaments and the resultant strand. This tension reducing means is adapted to reduce the filament tension to about 0.05 to 0.4 gram per denier and preferably 0.1 to 0.3 gram per denier. This reduced tension is also substantially equal to the tension at the hereinafter-mentioned winding apparatus. The tension reducing means is preferably mounted in the bottom of the quench chamber, but at a point below the bottom of the quench air inlet screen in order to avoid turbulence in the quench zone. The position of the tension reducing means affects the tension of the yarn. As the tension reducing means is moved toward the winding apparatus, the tension at the winder increases and as this point is moved away from the winder the tension at the winder decreases. Since, in high speed operations, it is generally desirable to have the lowest possible tension, it is generally preferred to locate the tension reducing means as near to the spinneret as is practical without creating additional problems. Of course, the tension reduction and simultaneous convergence must be at a point where the temperature of the filaments is below the stick point. It is preferred, however, that the convergence point should be located so that the complete fiber strand is quenched uniformly, or the filament strand may be adversely affected. That is, even though the filaments may be at a temperature below the stick point, some filaments may be at a higher temperature than others. If the tension requirements permit, it is therefore preferred that the convergence point be at a location where all of the fibers are at substantially the same temperature. In order to permit the use of the apparatus for different types of polymers and for the production of different characters of yarn from the same polymer, the tension reducing means is preferably adjustably mounted so that the distance between the tension reducing means and the spinneret may be changed.

The two strands or yarns formed from each of the two threadlines of filaments are then passed through a single interfloor tube. From the interfloor tube the strands are passed directly to the winding apparatus which includes the usual fanning guide and rotating spindle. The speed of rotation of the winding apparatus should be such that a take-up speed of at least 1800 feet per minute and preferably at least 3200 feet per minute is attained.

Referring now to FIGS. 1 and 2 of the drawings, the figures show a single spinning block 10. The spinning block 10 has mounted therein four individual spinnerets 11, 12, 13 and 14, respectively. Each of spinnerets 11, 12, 13 and 14 is provided with two sets of orifices so as to produce two threadlines of filaments, each comprising threadlines 15 and 16, 17 and 18, 19 and 20 and 21 and 22, respectively. Each spinning block 10 may be duplicated four times to provide a single spinning beam. Accordingly, a single spinning beam is preferably provided, which results in the production of 32 threadlines. The additional spinning blocks and the spinning beam are not shown since they are simply duplicates of what is shown in the figures.

Spinning block 10 has integrally formed therewith a single quenching chamber 23. Quenching chamber 23 is supplied with air through a duct 24 and a screen 25 across the middle thereof. Quenching chamber 23 is divided into quench zones 25, 26, 27 and 28, respectively. Each of the quench zones thus is adapted to have two threadlines pass therethrough and be quenched. Mounted in the bottom of each quench zone is a pair of tension reducing means 29, 30, 31 and 32, respectively. Each pair of tension reducing means is adapted to receive two threadlines, for example threadlines 15 and 16 are converged and lubricated by tension reducing means 29, tension reducing means 30 receives threadlines 17 and 18, etc. Extended downwardly from each of the quench zones 25, 26, 27 and 28 are interfloor tubes 33, 34, 35 and 36, respectively. Each of the interfloor tubes 33, 34, 35 and 36 is adapted to have passed therethrough two strands or yarns 37 and 38, 39 and 40, 41 and 42 and 43 and 44, respectively.

The strands or yarns 41, 42, 43 and 44 pass through a set of four thread guides 45 and strands or yarns 37, 38, 39 and 40 pass through a second set of thread guides 46. The strands or yarns passing through thread guides 45 then pass to a winding apparatus 47 while the strands or yarns passing through the thread guides 46 pass to winding apparatus 48. Winding apparatus 48 includes four fanning traverses 49 and four winding spindles 50.

Similarly, winding apparatus 48 includes fanning traverses 51 and winding spindles 52.

FIGS. 3–7, inclusive, show, in somewhat greater detail, tension reducing means 29 including a mounting post or block 53. Slidably mounted on mounting block 53 is mounting ring 54. Mounting ring 54 may have its vertical position on mounting block 53 changed by sliding the same up and down on mounting block 53 and fixing it in position by means of set screws 55 or other appropriate locking means. Mounted on mounting ring 54 is a pair of guide means 56 and 57, respectively. Guide means 56 and 57 have mounted therein cylindrical guides 58 and 59, respectively. Guides 58 and 59 have formed in their front surface V-shaped notches 60 and 61, respectively. Apertures 62 and 63 are formed longitudinally through the center of guides 58 and 59, respectively. Connected to the rear-most end of channels 62 and 63 are lubricant supply tubes 64 and 65. Leading from the back of the cutout portions of the guides 56 and 57 are drain channels 68 and 69. Channels 68 and 69 are connected to drain tubes 70 and 71, respectively.

In the operation of the tension reducing means of FIGS. 3–7, each of the threadlines 15 and 16 are converged in the V-shaped slots 60 and 61, respectively. Simultaneously with the convergence of the threadlines in slots 60 and 61, lubricant, which is also a treating agent for the strand or yarn, is supplied under pressure through lubricant tubes 64 and 65 so that it lubricates the surfaces of slots 60 and 61, respectively and at the same time treats the strands or yarns. Excess lubricant is drained away through drain channels 68 and 69 and drain tubes 70 and 71, respectively. It has been found in accordance with the present invention that if the slots 60 and 61 are turned to face the back of quench zone 25 the air passing through quench zone 25 will hold the filaments of the threadline in the slot. However, if the slots are turned toward the front of the quench zone 25 the guides are preferably provided with a ceramic bar (not shown) mounted in front of the slots 60 and 61.

The following examples illustrate the operation of the apparatus shown in the drawings to produce yarns from polyesters.

EXAMPLE 1

Table I below sets forth the physical characteristics of the apparatus used in the tests:

TABLE I

Spinning Block:
- 4 spinnerets
- 2 sets of 34 extrusion dies each (2 threadlines)
- Extrusion die capillary—0.34 mm diameter and 0.68 mm length Quench Chamber:
- 4 sections (2 threadlines per section)
- Each section screen—15.24 cm. wide and 1.44 m long
- Screens 11.43 cm below spinnerets Converging and Tension Reducing Guides:
- 8 (2 for each quench section—1 for each threadline)
- 1.95 m below spinneret face
- 39.37 cm below quench chamber screens Guide Tubes:
- 4 (1 for each quench section—2 threadlines per tube)
- 10.16 cm ID and 5.26 m long
- Top 12.7 cm below tension reducing guides Winders:
- 2 Barmag SW4RL (4 bobbins per winder)
- Traverse of one winder—1.11 m below bottom of guide tubes and traverse of second winder 1.72 m below bottom of guide tubes
- Fanning guides—100 cm above centerline of traverse In a first test, polyethylene terephthalate was fed to the spinnerets at a rate of 410 g./min. Quench air was supplied to the quench chamber at a rate of 50 fpm. Lubricant-finishing agents were supplied to the tension reduction means under pressure. The compositions and concentrations of lubricant-finishing agents were varied. Two typical lubricant formulations are set forth below:

| | | Wt. % |
|---|---|---|
| Formulation A: | | |
| Emery 6738 (Emery Industries, Mauldin, S.C.) | ethoxylated fatty acid - lubricant | 52.8 |
| POE 60 (Emery Industries) | emulsifier | 43.0 |
| RL3805-FL (Proctor Chemical Co., Salisbury, N.C.) | antistatic and wetting agent | 2.6 |
| Naugard 445 (Uniroyal Chemical Co., Naugatuck, Conn.) | antioxidant | 0.2 |
| Tridecyl phosphate | antistatic agent | 1.4 |
| Formulation B: | | |
| TL-971 (ICI America, Inc. Stanford, Conn.) | ethoxylated fatty acid - lubricant | 65.8 |
| Tergitol 15-9 (Union Carbide Corp., New York, N.Y.) | metal salts of sulfates of alcohols-wetting agent | 15.0 |
| Tergitol 15-S-12 (Union Carbide Corp.) | ethoxylates and ethoxysulfates of alcohols-wetting agent | 15.0 |
| R3805 FL (Proctor Chemical, Salisbury, N.C.) | antistatic and wetting agent | 2.6 |
| Naugard 445 (Uniroyal Chemical Co.) | antioxidant | 0.2 |
| Tridecyl phosphate | antistatic agent | 1.4 |

It was found that lubricant-finish levels of about 0.5% FOY were best and that formulation B was superior to the other formulations.

The test of this example was brief and was conducted primarily to survey high speed operation.

The physical properties of the yarns produced during this test are set forth in Tables II and III below:

TABLE II

| | | POY Physical Properties | | | | | | |
|---|---|---|---|---|---|---|---|---|
| Yarn | Den. | Breaking Strength (gm) | Tenacity (g/d) | Elong. (%) | Natural Draw (%) | Uster (%)[a] | BWS[c] (%) | Takeup Speed |
| 1 | 252 | 671 | 2.66 | 148 | 36.4 | 1.17 | — | 3200 m/m |
| 2 | 244 | 596 | 2.44 | 138 | 36.9 | 1.12 | — | 3200 m/m |
| 3 | 231 | 603 | 2.6 | 125 | 27.1 | 1.45 | 61.6 | 3500 m/m |
| 4 | 231 | 579 | 2.5 | 118 | 29.5 | — | 59.5 | 3500 m/m |

TABLE II-continued

| | | | POY Physical Properties | | | | | |
|---|---|---|---|---|---|---|---|---|
| Yarn | Den. | Breaking Strength (gm) | Tenacity (g/d) | Elong. (%) | Natural Draw (%) | Uster (%)[a] | BWS[c] (%) | Takeup Speed |
| 5 | 187 | 560 | 2.99 | 96 | 17.9 | 1.10 | 55.8 | 4000 m/m |
| 6 | 189 | 554 | 2.93 | 93 | 16.8 | 1.39 | 55.2 | 4000 m/m |
| 7 | 146 | 497 | 3.40 | 74 | 10.4 | 1.65 | 21.9 | 4500 m/m |
| 8 | 149 | 535 | 3.59 | 77 | 10.5 | — | 30.6 | 4500 m/m |
| 9[b] | 154 | 579 | 3.76 | 68 | 7.6 | — | 5.4 | 5000 m/m |
| 10[b] | 153 | 561 | 3.67 | 65 | 6.2 | — | 5.3 | 5000 m/m |

[a]Most of the high Usters are due to long term drift.
[b]Very small packages.
[c]Boiling water shrinkage.

TABLE III

| | | POY Properties | | | | |
|---|---|---|---|---|---|---|
| | Spin | Crystallinity[a] | | | Kanebo | |
| Yarn | Speed | As Spun | Heat Treated[b] | Birefringence | Yarn Temp. (°C.) | Level (gm) |
| 1 | 3200 | 7.72 | — | 0.042 | 80° | 23.5 |
| 2 | 3200 | 8.25 | — | 0.041 | | |
| 3 | 3500 | 13.7 | 19.0 | 0.050 | 80° | 23.5 |
| 4 | 3500 | 10.5 | 14.3 | 0.050 | | |
| 5 | 4000 | 12.8 | 18.1 | 0.069 | 80° | 23.5 |
| 6 | 4000 | 16.3 | 14.7 | 0.066 | | |
| 7 | 4500 | 18.2 | 29.5 | 0.084 | 92° | 26.5 |
| 8 | 4500 | 16.3 | 24.3 | 0.078 | | |
| 9 | 5000 | 23.8 | 24.5 | 0.112 | 98 to 109° | 31.9–42.3 |
| 10 | 5000 | 20.4 | 25.6 | 0.117 | | |

[a]Determined from DSC curve
[b]Samples treated in boiling water shrinkage test

In the above test, slight problems were encountered at winding speeds above 4000 m/m, since the recommended upper operating speed of the winders utilized is 4000 m/m. However, operability at all speeds was successfully demonstrated. It should be noted here that, as the winding speed is increased, a decrease in the denier of the yarn is necessary to allow for drawing of the yarn to the final elongation desired.

A second test was conducted under the same conditions as the first test, except that a quench air rate of 90 fpm was used. The test was designed to produce yarns at different winding speeds for subsequent evaluation and further testing. The properties of the yarns produced in these tests are set forth in Tables IV and V below:

TABLE IV

| | | | POY Physical Properties | | | | | | |
|---|---|---|---|---|---|---|---|---|---|
| Takeup Speed | Den. | Breaking Load (gm) | Ten. (g/d) | Elong. (%) | Natural Elong. (%) | Boiling Water Shrinkage % | Uster (%) | FDR[c] | Birefringence |
| 3200 m/m[d] | 249 | 580 | 2.3 | 141 | 46 | 62 | 1.13 | 1.19 | 0.042 |
| 3500 m/m[a] | 236 | 612 | 2.6 | 119 | 32 | 57.1 | 1.14 | 1.18 | 0.072 |
| 4000 m/m[a] | 202 | 586 | 2.9 | 92 | 21 | 55.4 | 1.04 | 1.10 | 0.088 |
| 4750 m/m[b] | 191 | 674 | 3.5 | 68 | 8.8 | 7.9 | 0.90 | 1.14 | 0.106 |
| 5000 m/m[b] | 182 | 670 | 3.7 | 63 | 6.5 | 4.6 | 0.69 | 1.08 | 0.118 |

[a]Average of eight packages
[b]Average of four packages
[c]FDR = Filament Diameter Ratio
[d]Yarn prepared in a later trial.

TABLE V

| | POY Properties | | | |
|---|---|---|---|---|
| | POY As Received | | | |
| Takeup Speed | Crystallization Temp. (°C.) | % Crystallinity | POY Heatset[a] % Crystallinity | Drawn Yarn % Crystallinity |
| 3200 m/m | 109 | 8.34 | 22.81 | 18.74 |
| 3200 m/m | 107 | 4.44 | 21.89 | — |

TABLE V-continued

| | POY Properties | | | |
|---|---|---|---|---|
| | POY As Received | | | |
| Takeup Speed | Crystallization Temp. (°C.) | % Crystallinity | POY Heatset[a] % Crystallinity | Drawn Yarn % Crystallinity |
| 4000 m/m | 95 | 11.75 | 23.25 | 21.36 |
| 4000 m/m | 95 | 13.44 | 20.40 | — |
| 4750 m/m | 92 | 18.54 | 22.55 | 23.44 |
| 4750 m/m | 90 | 16.79 | 24.44 | — |
| 5000 m/m | 98 | 22.05 | 21.89 | 20.56 |
| 5000 m/m | 100 | 17.19 | 23.64 | |

[a]Heatset at 90° C. for one hour

The results of the above two tests led to the general observations that, as the winding speed increases, the tenacity, birefringence and crystallinity increase and the elongation, natural elongation, boiling water shrinkage and crystallization temperature decrease.

Samples of the yarns produced in the second test were drawtextured on a Scragg SDS II unit under the following conditions:

| | |
|---|---|
| Spindle Speed | 595,000 rpm |
| Twist | 65 tpi |
| 1st Heater | 175° C. |
| 2nd Heater | 180° C. |
| Stabilizing Overfeed | +16% |
| Takeup Overfeed | −5.7% |

with the following draw ratios and resultant deniers and spindle tensions:

| Original Yarn Winding Speed m/min. | Original Yarn Denier | Draw Ratio | Drawn Yarn Denier | Spindle Tension gm. Before | After |
|---|---|---|---|---|---|
| 3200 | 250 | 1.725 | 159 | 33 | 61 |
| 3500 | 237 | 1.580 | 164 | 32 | 64 |
| 4000 | 203 | 1.438* | 154* | 40 | 73* |
| 4750 | 192 | 1.197 | 174 | 33 | 66 |
| 5000 | 182 | 1.162 | 170 | 36 | 68 |

*Because of lack of proper quadrant arm, a draw ratio of 1.390 (believed to be optimum) could not be attained and the next lowest ratio (1.438) resulted in high tensions and low drawn yarn denier.

The yarn produced at a winding speed of 4750 m/min. was also friction drawtextured on the Scragg SDSII machine under the following conditions:

| | |
|---|---|
| Draw Ratio | 1.235 |
| D/Y Ratio* | 1.71 |
| Yarn Speed | 35 m/min. |
| 1st Heater | 190° C. |
| 2nd Heater | 175° C. |
| Stabilizing Overfeed | +14% |
| Takeup Overfeed | −9.7% |

*The D/Y Ratio is the ratio of the friction spindle disk speed to the yarn speed.

to produce spindle tensions of 51 and 52 grams before and after the spindle and a draw yarn denier of 166. The properties of the drawtextured yarns are set forth in Table VI below and compared with the properties of a commercial drawtextured yarn.

TABLE VI

| Problem # | Denier | Breaking Load | Tenacity | Elongation, % Crimp | Basic | Total | Leesona Skein Shrinkage |
|---|---|---|---|---|---|---|---|
| Scragg Pin | 159 | 598 gm | 3.8 g/d | 3.3 | 27.7 | 31.0 | 18% |
| Scragg Pin | 164 | 654 | 3.9 | 3.5 | 28.5 | 32.1 | 19 |
| Scragg Pin | 154 | 638 | 4.2 | 2.9 | 26.4 | 29.2 | 17 |
| Scragg Pin | 174 | 629 | 3.7 | 4.2 | 33.7 | 37.9 | 20 |
| Scragg Friction | 166 | 528 | 3.2 | 4.2 | 21.1 | 25.4 | 25 |
| Scragg Pin | 170 | 632 | 3.7 | 2.8 | 33.4 | 36.3 | 20 |
| Scragg Friction[a] | | | | | | | |
| Commercial | 153 | 582 | 3.8 | 2.7 | 25.5 | 28.2 | 23 |

[a]Textured from 250/34 (denier/filaments) POY. Draw ratio = 1.699; D/Y ratio - 1.66, Heaters - 200°, 180° C.

Drawtexturing performance was excellent in all cases. The elongations of the yarn from the yarn produced at a winding speed of 4000 m/min. are low due to the use of the higher than desired draw ratio. The yarn produced at winding speeds of 4750 and 5000 m/min. had high elongations, indicating that the draw ratios were slightly low. It is to be observed that the differences between the previously reported properties of the undrawn or original yarns produced at different winding speeds are compensated for during drawtexturing to produce drawn yarns of essentially the same properties.

The drawtextured yarns we examined microscopically for differences in cross-section distortion. Drawn yarn from the 3200 and 4000 m/min. yarns contained many filaments with extreme distortion, in addition to hexagonal and pentagonal cross sections. By contrast, drawn yarns from the 5000 m/min. yarn contained very few of the highly distorted cross sections and was much more uniform than the yarns produced at lower speeds. No significant differences in hand or appearance were noted between yarns produced at 3200 and 5000 m/min. in samples knitted on the FAK knitting machine.

Knits prepared from the drawtextured yarns were dyed with Eastman Blue GLF and the dye uniformity computed from reflectance data. The results are shown in Table VII below:

TABLE VII

| Dyeing Uniformity Run No. | 1 | 2 | 3 | 4 | 5 |
|---|---|---|---|---|---|
| POY Denier | 250 | 237 | 203 | 192 | 182 |
| Takeup Speed, m/min. | 3200 | 3500 | 4000 | 4750 | 5000 |
| Scragg Pin Texturing | | | | | |
| Mean Color Value ($\overline{CV}$) | 111.1 | 94.6 | 86.7 | 122.2 | 133.8 |
| Variance ($\sigma^2$) | 11.4 | 28.3 | 12.5 | 5.7 | 3.9 |
| Number of Samples (N) | 8 | 7 | 8 | 4 | 4 |
| Scragg Friction Texturing | | | | | |
| $\overline{CV}$ | | | | 133.2 | |
| $\sigma^2$ | | | | 4.4 | |
| N | | | | 4 | |

While the Color Values, based on a common control varied somewhat, it is believed that these differences can be attributed to utilizing the wrong draw during drawtexturing.

Four packages of the yarn produced at a winding speed of 4750 m/min. were friction drawtextured at 460 m/min. on a Scragg Super Draw Set VII draw texturing machine. The yarn ran well in the test. It should be observed that only one other commercially available, partially oriented yarn is known to run acceptably at the test speed. However, it was observed that the draw test yarn had better shrinkage properties than the drawn commercial yarn.

It was also found in the spinning tests set forth above, that productivity increases as the winding speed is increased. The productivity at various winding speeds it listed below.

| Winding Speed m/min. | Original Yarn Denier | Productivity lb./hr. |
|---|---|---|
| 3200 | 250 | 11.75 |
| 4000 | 202 | 11.87 |
| 5000 | 182 | 13.37 |
| 5000 | 170 | 12.49 |

Finally, it is to be noted that the polymer feed rate was 410 g/min., as set forth above, while a conventional operation utilizes a feed rate of 352 g/min.

EXAMPLE 2

A second set of tests was carried out utilizing the same basic apparatus and conditions as set forth in Example 1, with the following exceptions:

1 Spinneret with 2 sets of extrusion dies (2 threadlines)
1 Quench Section:
Air velocities were varied from 40 to 120 fpm
2 Converging and Tension Reducing Guides:
Tests were run with the open end of the V facing away from the quench section screen and a ceramic bar below the guide and others with the V facing toward the screen. Guides were located 1.96 meters below the spinneret in most tests and 2.26 meters below in some tests.
1 Guide Tube:
A 6-inch diameter tube was tried in some tests
1 Winder with 2 Bobbins (2 threadlines):
Winding speed was 3200 m/min. in all tests
The properties of the yarns produced are set forth in Tables VIII, IX and X below:

TABLE VIII

| Sample No. | Quench Air Flow (fpm) | Uster (%) | Denier | POY Properties Trials 1, 2, and 3 Tenacity (gpd) | Elongation (%) | Natural Draw Elongation (%) | Filament Diameter Ratio | Birefringence |
|---|---|---|---|---|---|---|---|---|
| Trial 1[b] | | | | | | | | |
| 1 | 45 | 1.25 | 251 | 2.4 | 135 | 39 | 1.08 | — |
| 2 | 45 | 1.38 | 248 | 2.5 | 140 | 38 | 1.08 | — |
| Trial 2[b] | | | | | | | | |
| 1 | 50 | 1.17 | 252 | 2.7 | 146 | 36 | 1.42 | .042 |
| 2 | 50 | 1.12 | 244 | 2.4 | 138 | 37 | 1.17 | .041 |
| 3 | 110 | 1.25 | 248 | 2.4 | 136 | 34 | — | — |
| Trial 3[c] | | | | | | | | |
| 1 | 75 | 1.19 | 253 | 2.3 | 167 | 50 | 1.06 | 0.44 |
| 2 | 75 | 1.25 | 254 | 2.4 | 168 | 48 | 1.32 | 0.40 |
| 3[a] | 95 | 1.34 | 251 | 2.4 | 171 | 48 | — | — |
| 4[a] | 95 | 1.28 | 248 | 2.3 | 158 | 47 | — | — |
| 5[a] | 95 | 1.15 | 248 | 2.4 | 162 | 47 | — | — |

[a]Interfloor tube one foot shorter than for all above yarns
[b]Finish application guides facing away from the quench air screen
[c]Finish application guides facing into the quench air screen

TABLE IX

| Sample No. | Quench Air Flow (fpm) | Denier | POY Properties Tenacity (gpd) | Elongation (%) | Natural Draw Elongation (%) | Boiling Water Shrinkage (%) | Uster (%) |
|---|---|---|---|---|---|---|---|
| 1 | 75 | 249 | 2.3 | 140 | 46.8 | 60 | 1.15 |
| 2 | 75 | 249 | 2.3 | 142 | 48.4 | 62 | 1.09 |
| 3 | 85 | 248 | 2.2 | 137 | 46.6 | 62 | 1.21 |
| 4 | 85 | 250 | 2.3 | 144 | 44.8 | 62 | 1.15 |
| 5 | 70 | 248 | 2.4 | 143 | 47.2 | 62 | 1.12 |
| 6 | 70 | 248 | 2.4 | 143 | 47.4 | 62 | 1.09 |
| 7 | 85 | 250 | 2.3 | 140 | 46.4 | 64 | 1.24 |
| 8 | 85 | 250 | 2.3 | 141 | 48.2 | 62 | 1.04 |
| 9 | 120 | 249 | 2.3 | 141 | 45.0 | 62 | 1.18 |
| 10 | 120 | 250 | 2.3 | 135 | 44.4 | 62 | 1.07 |
| Avg. | | 249 | 2.3 | 141 | 46.5 | 62 | 1.13 |

TABLE X

| Sample No. | Denier | POY Properties Trial 5 Tenacity (gpd) | Elongation (%) | Natural Draw Elongation (%) | Boiling Water Shrinkage (%) | Uster (%) | I. V. |
|---|---|---|---|---|---|---|---|
| 1 | 251 | 2.4 | 140 | 40.4 | 66 | 1.52 | — |
| 2 | 250 | 2.4 | 142 | 40.4 | 63 | 1.62 | 0.59 |
| 3 | 251 | 2.4 | 140 | 40.8 | 65 | 1.49 | — |
| 4 | 252 | 2.4 | 140 | 40.4 | 64 | 1.58 | 0.58 |
| 5 | 252 | 2.5 | 144 | 41.0 | 64 | 1.53 | 0.57 |
| 6 | 250 | 2.4 | 148 | 41.2 | 66 | 1.61 | — |
| 7 | 250 | 2.4 | 145 | 40.8 | 64 | 1.58 | — |

TABLE X-continued

| | | | POY Properties Trial 5 | | | | |
|---|---|---|---|---|---|---|---|
| 8 | 250 | 2.4 | 146 | 40.6 | 68 | 1.85 | 0.57 |
| Avg. | 251 | 2.4 | 143 | 40.7 | 65 | 1.60 | 0.58 |

[a]Other POY properties include

| DSC Analysis | |
|---|---|
| Tg | 68° |
| Crystallization temp. | 108° |
| Melting point | 257° |
| Freezing point | 207° |
| Birefringence | 0.045 |
| Kanebo analysis | |
| Ig | 75.2° C. |
| Zero strength temp. | 238° C. |
| Max. stress-first peak | 0.088 g/den |

It was found, in the above tests that a quench air velocity of about 60 fpm was preferable. While the orientation of the V of the tension reducing guide made little difference, a guide facing away from the quench air screen and having a ceramic bar below the guide is preferred. The location of the tension reducing guides 1.96 meters below the spinneret increased the tension at the winder to 35 to 40 gm and resulted in better winder performance. However, lowering the guide to 2.26 meters made no apparent difference in the observed tension or the yarn properties. The use of a 6-inch diameter guide tube made no apparent difference, but is preferred because of easier string-up and easier viewing of the threadlines. In general the properties of the yarns are similar to the properties of commercial yarns, except that the % Uster was found to be higher than desired. However, it was found that the % Uster decreases with aging and also that subsequent drawtexturing substantially reduces the % Uster (for example, 1.24 to 0.92). The latter is unusual, since drawtexturing does not improve the % Uster of conventionally produced, partially oriented yarns.

Eight packages of 250 denier/34 threadline yarn produced in Trial 1 above, eight packages of 250/34 commercial yarn and eight packages of 250/34 yarn produced on conventional equipment were pin drawtextured on an ARCT 480 machine under the following conditions:

| | |
|---|---|
| Draw Ratio | 1.65 |
| Twist | 62 tpi |
| Spindle Speed | 361,000 rpm |
| First Heater | 180° C. |
| Second Heater | 200° C. |
| No. 3 Drive Roll | +16% |
| Creel Drive Roll | −10% |
| Takeup Drive Roll | +0.4% |

and the following tensions were observed:

| Samples | Spindle Tension gm. Before | After |
|---|---|---|
| 1 pkg. Commercial (Spindle Check) | 20 | 45 |
| 8 pkgs. Trial 1 | 23.9 | 50.4 |
| 8 pkgs. Conventional | 26.6 | 57.2 |
| 8 pkgs. Commercial | 22.2 | 45.2 |

Eight packages of yarn produced in Trial 2, above, were pin drawtextured to the core on the same machine under the following conditions:

| | |
|---|---|
| Draw Ratio | 1.71 |

-continued

| | |
|---|---|
| Twist | 62 tpi |
| Spindle Speed | 361,000 rpm |
| First Heater | 180° C. |
| Second Heater | 200° C. |
| No. 3 Drive Roll | +15% |
| Creel Drive Roll | −10% |
| Takeup Drive Roll | +0.4% |
| Prespindle Tensions | 30 to 35 gm. |
| Postspindle Tensions | 52 to 57 gm. |

The properties of the drawtextured yarns produced in the four sets of materials are listed in Table XI below:

TABLE XI

| Sample No. | Textured Yarn Physical Properties Trials 1 and 2: Denier | Tenacity (gpd) | Elongation, % Crimp | Basic | Total | Leesona Skein Shrinkage, % |
|---|---|---|---|---|---|---|
| Trial 1[b] | | | | | | |
| 1 | 165 | 3.5 | 5.3 | 28.6 | 33.9 | 23.8 |
| 2 | 162 | 3.9 | 4.4 | 31.8 | 36.2 | 20.3 |
| 3 | 164 | 3.9 | 5.0 | 32.5 | 37.5 | 22.1 |
| 4 | 163 | 3.8 | 4.7 | 33.1 | 37.8 | 23.2 |
| Avg. | 164 | 3.8 | 4.8 | 31.5 | 36.4 | 22.4 |
| Commercial[b] | | | | | | |
| a | 164 | 3.7 | 4.5 | 34.1 | 38.7 | 23.3 |
| Conventional | | | | | | |
| a | 164 | 3.7 | 3.8 | 31.9 | 35.7 | 22.7 |
| Trial 2[c] | | | | | | |
| 1 | 154 | 4.1 | 3.1 | 29.6 | 32.7 | 18.8 |
| 2 | 159 | 3.9 | 4.0 | 28.0 | 32.0 | 22.0 |
| 3 | 159 | 3.9 | 3.8 | 27.2 | 31.0 | 21.0 |
| 4 | 157 | 4.0 | 3.6 | 28.1 | 31.7 | 20.5 |
| Avg. | 157 | 4.0 | 3.6 | 28.2 | 31.8 | 20.6 |

[a]Average of four packages
[b]Draw Ratio = 1.65
[c]Draw Ratio - 1.71

All four sets of yarn ran well in the drawtexturing tests. The tensions before and after the spindles were higher for the Trial 1 yarn and for the Conventional yarn than for the Commercial yarn. The Trial 1 and Conventional yarns were also found to string up easier than the Commercial yarn. The Commercial yarn was found to have a higher elongation than the others. Yarns from Trial 2 showed a higher tenacity and lower elongation and Leesona Skein Shrinkage than yarn from Trial 1.

Knitted samples were prepared on an FAK knitting machine from the textured yarns and dyed with Eastman Blue GLF. Color Value data from Color Eye reflectance readings were as follows:

| | Trial 1 | Commercial | Conventional | Spindle Check |
|---|---|---|---|---|
| $\overline{CV}$ | 100 | 100 | 100 | 100 |
| $\sigma^2$ | 0.4 | 3.6 | 9.6 | 3.6 |
| N | 7 | 8 | 8 | 11 |

The Color Value variations appeared less for the Trial 1 yarn than for the conventional yarn. The Trial 1 yarn showed some dark flashes but not as many as previously observed with yarns made conventionally. The Trial 2 drawtexturing was run to determine whether winder adjustments had eliminated dark flashes in dyed knits. No dark dye flashes were observed, indicating that winder adjustments had eliminated the problem.

Eight packages of yarn from Trial 4 were drawtextured on both the ARCT 480 and the Scragg Super Draw Set II pin texturing units under the following conditions:

| | ARCT | Scragg |
|---|---|---|
| Draw Ratio | 1.65 | 1.725 |
| Spindle Speed | 361,000 rpm | 595,000 rpm |
| Twist | 62 tpi | 65 tpi |
| First Heater | 180° C. | 175° C. |
| Second Heater | 200° C. | 180° C. |
| No. 3 Drive Roll | +16% | |
| Creel Drive Roll | −8% | |
| Takeup Drive Roll | 0% | |
| Stabilizing Overfeed | | +16% |
| Takeup Overfeed | | −5.7% |
| Prespindle Tension | 27 gm | 33 gm |
| Postspindle Tension | 51 gm | 61 gm |

The physical properties of the drawtextured yarns from Trial 4 are set forth in Table XII below:

TABLE XII

Textured Yarn Physical Properties Trial 4

| Sample | Denier | Tenacity (gpd) | Elongation (%) Crimp | Basic | Total | Initial Modulus (gpd) | Leesona Skein Shrinkage (%) | Spindle Tensions (gms) Before | After | Quench Air (fpm) |
|---|---|---|---|---|---|---|---|---|---|---|
| ARCT Textured | | | | | | | | | | |
| 1 | 161 | 3.4 | 4.3 | 27.1 | 31.4 | 18.7 | 23.4 | 24 | 55 | 75 |
| 2 | 163 | 3.7 | 5.3 | 33.2 | 38.5 | 17.5 | 23.4 | 26 | 50 | 75 |
| 3 | 162 | 3.5 | 5.4 | 27.8 | 33.2 | 16.2 | 26.2 | 27 | 45 | 85 |
| 4 | 162 | 3.6 | 5.1 | 30.3 | 35.4 | 15.7 | 21.9 | 27 | 45 | 85 |
| 5 | 164 | 3.4 | 3.7 | 27.9 | 31.6 | 19.1 | 22.7 | 25 | 59 | 70 |
| 6 | 162 | 3.8 | 4.7 | 32.8 | 37.5 | 17.2 | 22.5 | 27 | 52 | 70 |
| 7 | 164 | 3.4 | 5.0 | 28.2 | 33.2 | 16.5 | 25.4 | 27.5 | 46 | 85 |
| 8 | 163 | 3.7 | 5.1 | 30.5 | 35.6 | 15.8 | 22.5 | 29 | 59 | 85 |
| Average | 163 | 3.6 | 4.8 | 29.7 | 34.6 | 17.1 | 23.5 | 27 | 51 | |
| Scragg Textured | | | | | | | | | | |
| 1 | 159 | 3.9 | 3.2 | 27.2 | 30.4 | 17.0 | 17.9 | 34 | 61 | 75 |
| 2 | 158 | 3.7 | 2.8 | 28.7 | 31.5 | 19.0 | 17.3 | 32 | 59 | 75 |
| 3 | 157 | 3.8 | 3.6 | 27.7 | 31.3 | 16.9 | 17.7 | 33 | 61 | 85 |
| 4 | 160 | 3.7 | 3.4 | 27.7 | 31.1 | 17.6 | 18.2 | 32 | 61 | 85 |
| 5 | 159 | 3.7 | 3.8 | 27.7 | 31.5 | 16.7 | 17.5 | 32 | 58 | 70 |
| 6 | 158 | 3.8 | 2.5 | 27.8 | 30.3 | 20.5 | 18.2 | 32.5 | 61 | 70 |
| 7 | 159 | 3.9 | 3.7 | 30.7 | 34.4 | 16.6 | 17.7 | 33.5 | 63 | 85 |
| 8 | 159 | 3.6 | 3.5 | 24.0 | 27.5 | 19.2 | 18.8 | 34 | 64 | 85 |
| Average | 159 | 3.8 | 3.3 | 27.7 | 31.0 | 17.9 | 17.9 | 33 | 61 | |

In both instances the yarn ran well with no breaks or broken filaments.

The textured yarns produced from Trial 4 yarns were made into FAK knits and dyed with Eastman Blue GLF. The results were as follows:

| | ARCT | Scragg |
|---|---|---|
| $\overline{CV}$ | 112.1 | 100.0 |
| $\sigma^2$ | 11.1 | 13.8 |
| N | 8 | 8 |

Twenty-four packages of yarn from Trial 5 were drawtextured on the ARCT 80 under the following conditions:

| | |
|---|---|
| Draw Ratio | 1.65 |
| Spindle Speed | 361,000 rpm |
| Twist | 64 tpi |
| First Heater | 190° C. |
| Second Heater | 220° C. |
| No. 3 Drive Roll | +16% |
| Creel Drive Roll | −8% |
| Takeup Drive Roll | 0% |

The physical properties of the textured yarn are set forth in Table XIII below:

TABLE XIII

Textured Yarn Physical Properties Trial 5

| Sample | Denier | Tenacity (gpd) | Elongation (%) Crimp | Basic | Total | Initial Modulus (gpd) | Leesona Skein Shrinkage (%) |
|---|---|---|---|---|---|---|---|
| 1 | 162 | 3.7 | 3.9 | 29.0 | 32.9 | 17.7 | 21.9 |
| 2 | 164 | 3.8 | 3.6 | 29.7 | 33.3 | 17.3 | 19.7 |
| 3 | 162 | 3.8 | 3.1 | 30.5 | 33.6 | 17.7 | 20.4 |
| 4 | 162 | 3.9 | 3.9 | 31.3 | 35.2 | 18.7 | 22.8 |
| 5 | 162 | 3.8 | 3.3 | 30.1 | 33.5 | 18.5 | 21.4 |
| 6 | 164 | 3.8 | 3.2 | 31.2 | 34.4 | 18.3 | 20.8 |
| 7 | 164 | 3.6 | 4.2 | 30.5 | 34.1 | 17.7 | 22.8 |
| 8 | 161 | 3.7 | 3.9 | 31.2 | 35.1 | 17.8 | 22.8 |
| Avg. | 163 | 3.8 | 3.6 | 30.5 | 34.0 | 18.0 | 21.6 |

Texturing performance was good and the physical properties as set forth above, were normal.

Textured, Trial 5 yarn was made into knitted samples on the FAK knitting machine and dyed as previously set forth. The results were:

| | |
|---|---|
| $\overline{CV}$ | 100 |
| $\sigma^2$ | 1.84 |
| N | 23 |

Good package to package unformity was observed and there were no dark dye flashes or barre'.

1200 pounds of yarn from Trial 5 were drawtextured by an independent texturing company under the following conditions:

| | |
|---|---|
| Draw Ratio | 1.66 |
| Spindle Speed | 528,450 rpm |
| Twist | 64.6 tpi |
| First Heater | 190° C. |
| Second Heater | 210° C. |
| No. 3 Drive Roll | +14% |
| Creel Drive Roll | −8% |
| Takeup Drive Roll | 0.5% |

The resultant physical properties are set forth in Table XIV below:

TABLE XIV

| Textured Yarn Physical Properties Mill Trial | | | | | | | | |
|---|---|---|---|---|---|---|---|---|
| Textured Yarn | Denier | Breaking Load (gm) | Tenacity (gpd) | Elongation (%) Crimp | Basic | Total | Initial Modulus (gpd) | Leesona Skein Shrinkage (%) |
| 1 | 169 | 669 | 3.9 | 2.5 | 37.1 | 39.6 | 18.4 | 12.9 |
| 2 | 167 | 633 | 3.8 | 2.2 | 34.6 | 36.8 | 17.2 | 11.8 |
| 3 | 166 | 631 | 3.8 | 1.2 | 33.0 | 34.2 | 26.8 | 12.2 |
| 4 | 168 | 648 | 3.8 | 2.1 | 33.3 | 35.4 | 18.7 | 10.9 |
| 5 | 169 | 607 | 3.6 | 2.1 | 31.4 | 33.5 | 18.8 | 12.0 |
| 6 | 169 | 638 | 3.8 | 1.4 | 37.5 | 38.9 | 19.8 | 10.9 |
| 7 | 166 | 635 | 3.8 | 1.3 | 33.3 | 34.6 | 22.9 | 12.2 |
| 8 | 167 | 526 | 3.1 | 1.1 | 25.2 | 26.3 | 24.7 | 11.8 |
| Avg. | 168 | 623 | 3.7 | 1.7 | 33.2 | 34.9 | 20.9 | 11.8 |

The textured yarn can be seen to have high denier and basic elongation and low crimp elongation and Leesona Skein Shrinkage.

One hundred of the textured packages were knitted and dyed by the same independent company.

Variance was found to be 3.86, which is commercially acceptable, while a variance of 3.0 or less is considered excellent.

A doubleknit fabric from the textured yarn was sent to an independent company for commercial dyeing. The resulting fabrics showed only traces of barre' and were considered commercial.

While specific examples of equipment, methods and materials are set forth herein, it is to be understood that these specific declarations and designations are not to be considered limiting and that many variations and modifications thereof will be apparent to one skilled in the art.

What is claimed is:

1. A method of forming at least one strand of filaments from a plurality of polymeric filaments comprising: extruding at least one threadline of filaments from a molten polymer; passing said threadline of filaments to a quenching zone and quenching the same; reducing the tension on said threadline of filaments, by converging said threadline of filaments against a stationary guide to form a single strand at a point immediately adjacent the downstream end of said quenching zone while simultaneously applying a lubricant to the surfaces of said guide which are in contact with said, said filaments and said strand; and winding said strand to form a yarn package at a take-up speed of at least about 1800 meters per minute and at a tension substantially equal to said reduced tension.

2. A method in accordance with claim 1 wherein the tension on the threadline of filaments is reduced to a value between about 0.05 and 0.4 gram per denier.

3. A method in accordance with claim 2 wherein the tension on the threadline of filaments is reduced to a value between about 0.1 and 0.3 gram per denier.

4. A method in accordance with claim 1 wherein the polymer is a polyester.

5. A method in accordance with claim 4 wherein the polyester polymer is a polyethylene terephthalate.

6. A method in accordance with claim 1 wherein not more than two threadlines of filaments are passed through a single quenching zone and converged into two strands.

7. A method in accordance with claim 1 wherein at least eight threadlines of filaments are extruded, two each of said at least eight threadlines are passed through each of at least four quenching zones, said at least eight threadlines are converged into at least eight strands against at least eight guides and each of said at least eight strands is wound on a separate winding means.

8. A method in accordance with claim 1 wherein the guide is a ceramic guide.

9. A method in accordance with claim 8 wherein the guide is a V-shaped guide.

10. A method in accordance with claim 1 wherein the lubricant is applied to the surface of the guide under positive pressure.

11. A method in accordance with claim 1 wherein the lubricant is also a finish for the strand.

12. A method in accordance with claim 1 wherein the winding take-up speed is at least about 3200 meters per minute.

13. A method in accordance with claims 1, 2, 3, 4, 5, 6, 7, 8, 9, 10, 11 or 12 wherein the wound strand is subsequently drawtextured.

* * * * *

UNITED STATES PATENT AND TRADEMARK OFFICE

CERTIFICATE OF CORRECTION

PATENT NO. : 4247505

DATED : January 27, 1981

INVENTOR(S) : Henry G. Jackson

It is certified that error appears in the above-identified patent and that said Letters Patent are hereby corrected as shown below:

Col.18 line 7, after "said", first occurrence, insert--threadline--.

Signed and Sealed this

*Nineteenth* Day of *May 1981*

[SEAL]

*Attest:*

RENE D. TEGTMEYER

*Attesting Officer*

*Acting Commissioner of Patents and Trademarks*